US007097326B1

(12) United States Patent
Pipolo

(10) Patent No.: US 7,097,326 B1
(45) Date of Patent: Aug. 29, 2006

(54) LAMP AND STORAGE COMBINATION ASSEMBLY

(76) Inventor: Marco Pipolo, 300 E. 59th St., Apt. #2805, New York City, NY (US) 10022

( * ) Notice: Subject to any disclaimer, the term of this patent is extended or adjusted under 35 U.S.C. 154(b) by 0 days.

(21) Appl. No.: 11/075,328

(22) Filed: Mar. 7, 2005

(51) Int. Cl.
*F21V 33/00* (2006.01)

(52) U.S. Cl. ..... 362/253; 362/154; 362/133; 362/132; 362/92

(58) Field of Classification Search ..... 362/154, 362/253, 133, 132, 127, 92
See application file for complete search history.

(56) References Cited

U.S. PATENT DOCUMENTS 1,739,239 A * 10/1929 Keffer
4,308,724 A * 1/1982 La Ginestra ..... 62/126
5,115,940 A * 5/1992 Friedman
5,513,496 A * 5/1996 Stokes
5,618,101 A * 4/1997 Yeh
5,733,035 A * 3/1998 Spencer et al.
5,873,646 A * 2/1999 Fjaestad et al.
D434,518 S * 11/2000 Rivers
6,238,061 B1 * 5/2001 McKenzie et al.
6,286,719 B1 * 9/2001 Haines
6,402,338 B1 * 6/2002 Mitzel et al. ..... 362/154
6,447,083 B1 * 9/2002 Chiapetta et al. ..... 312/404
6,953,258 B1 * 10/2005 Goins ..... 362/155

* cited by examiner

*Primary Examiner*—Laura K. Tso

(57) ABSTRACT

A lamp and storage combination assembly includes a housing that has a bottom wall, a top wall and peripheral wall that is attached to and extends between the top and bottom walls. The peripheral wall has a cavity extending therein that is bounded by a lower wall, an upper wall and a perimeter wall extending between the upper and lower walls. A door is hingedly coupled to the peripheral wall and is selectively positionable in a closed position closing the cavity or in an open position opening the cavity. A light socket is attached to the top wall of the housing. A power supply is electrically coupled to the light socket.

5 Claims, 3 Drawing Sheets

LAMP AND STORAGE COMBINATION ASSEMBLY

BACKGROUND OF THE INVENTION

1. Field of the Invention

The present invention relates to lamp assemblies and more particularly pertains to a new lamp assembly for holding beverages and foot items in a thermally insulated, hidden and easily accessible area.

2. Description of the Prior Art

The use of lamp assemblies is known in the prior art. U.S. Pat. No. 6,238,061 describes a lamp that includes a built in alarm clock and a secondary power supply. Another type of lamp assembly is U.S. Pat. No. 1,739,239 having a lamp base having a compartment therein for holding cigarettes, tobacco and smoking supplies.

While these devices fulfill their respective, particular objectives and requirements, the need remains for a lamp assembly that includes at least one compartment adapted for holding food, and particularly beverage, containers. The lamp assembly should be adapted for holding the food items in a thermally insulated environment to ensure that the food items do not quickly move to ambient temperature. The lamp assembly may then be positioned in an easily accessible area, such as adjacent to a sitting area, so that the food items are readily retrievable.

SUMMARY OF THE INVENTION

The present invention meets the needs presented above by comprising a housing that has a bottom wall, a top wall and peripheral wall that is attached to and extends between the top and bottom walls. The peripheral wall has a cavity extending therein that is bounded by a lower wall, an upper wall and a perimeter wall extending between the upper and lower walls. A door is hingedly coupled to the peripheral wall and is selectively positionable in a closed position closing the cavity or in an open position opening the cavity. A light socket is attached to the top wall of the housing. A power supply is electrically coupled to the light socket.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
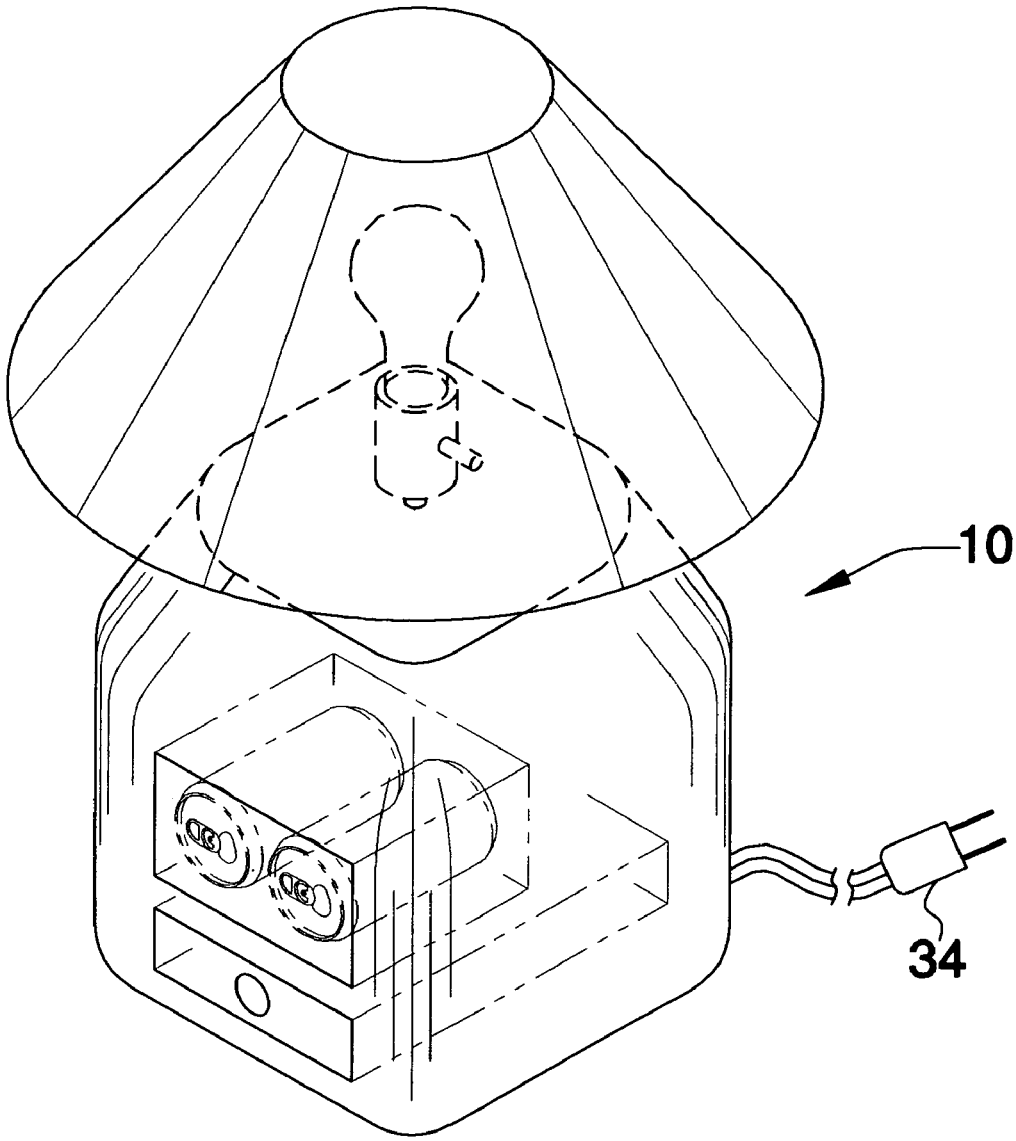
FIG. 1 is a perspective view of a lamp and storage combination assembly according to the present invention.
Figure 3:
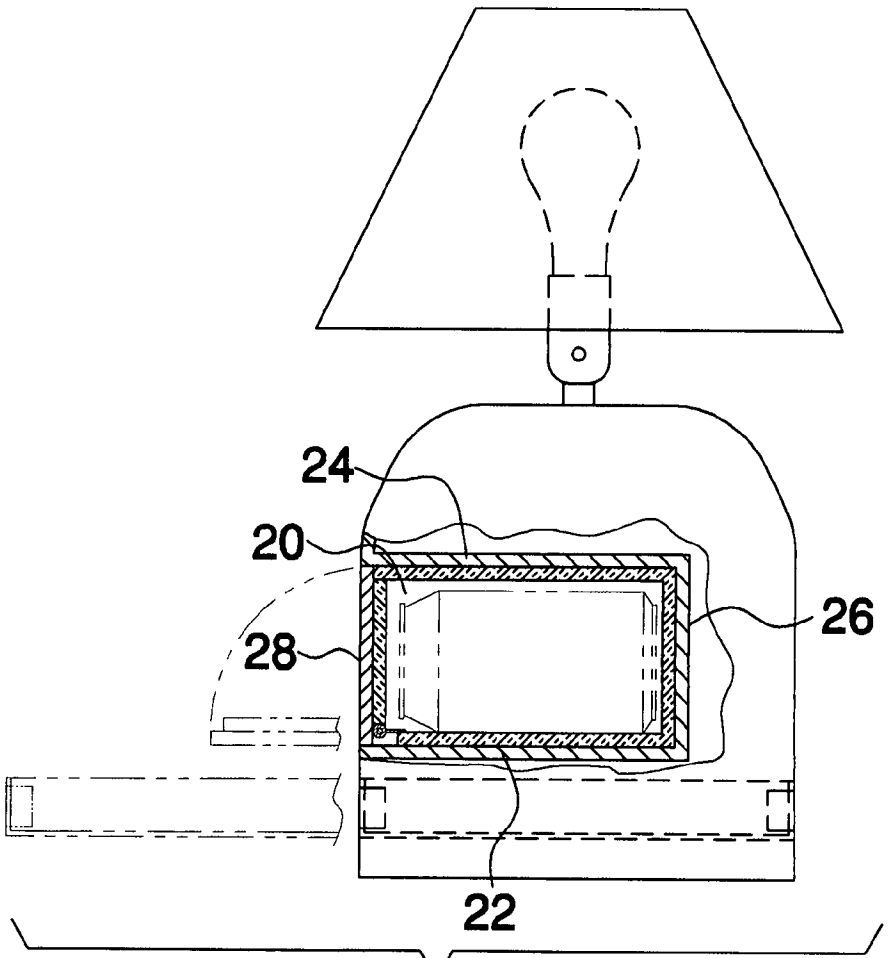
FIG. 3 is a side broken view of the present invention.
Figure 2:
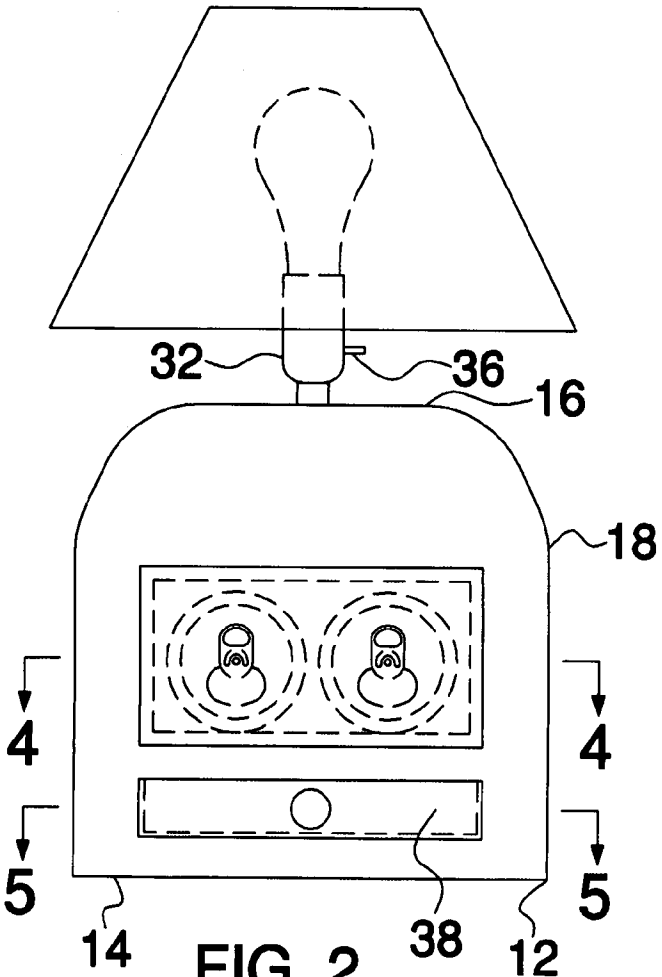
FIG. 2 is a front view of the present invention.
Figure 4:
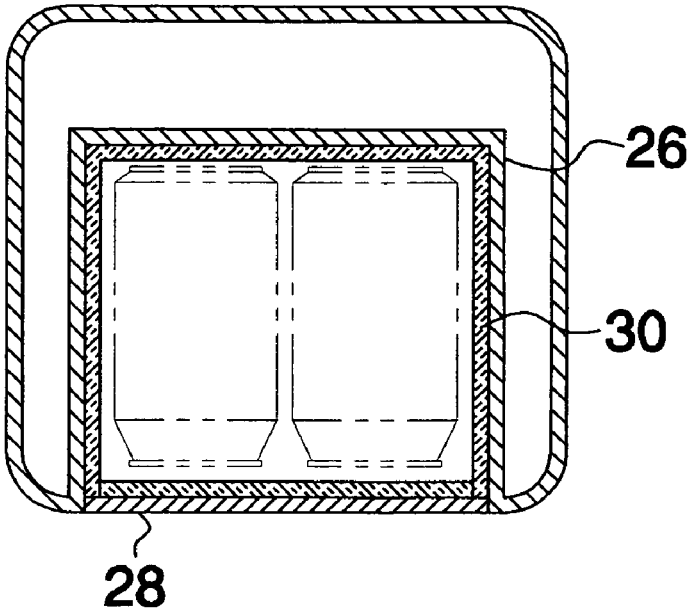
FIG. 4 is a cross-sectional view taken along line 4—4 of FIG. 2 of the present invention.
Figure 5:
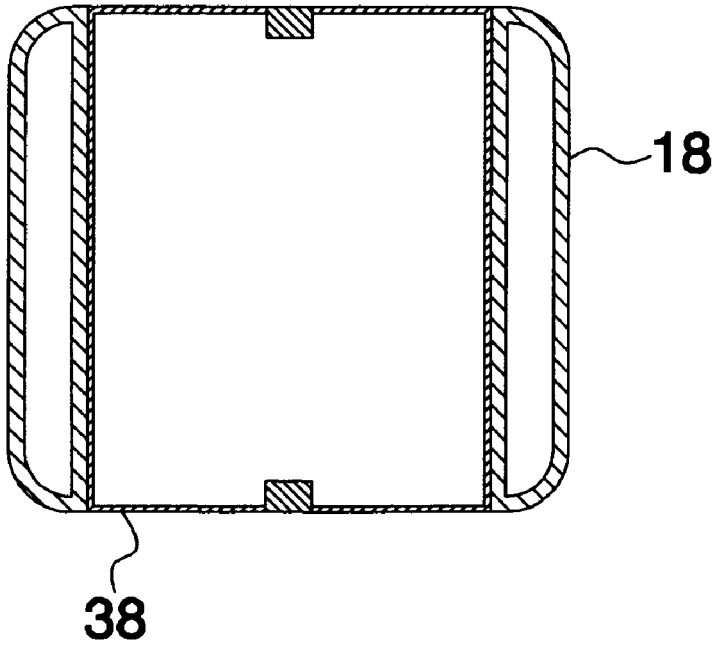
FIG. 5 is a cross-sectional view taken along line 5—5 of FIG. 5 of the present invention.

With reference now to the drawings, and in particular to FIGS. 1 through 5 thereof, a new lamp assembly embodying the principles and concepts of the present invention and generally designated by the reference numeral 10 will be described.

As best illustrated in FIGS. 1 through 5, the lamp and storage combination assembly 10 generally comprises a housing 12 having a bottom wall 14, a top wall 16 and peripheral wall 18 that is attached to and extends between the top 16 and bottom 14 walls. The peripheral wall 18 has a cavity 20 extending therein. A lower wall 22, an upper wall 24 and a perimeter wall 26 extending between the upper 24 and lower 22 walls bound the cavity 20. A door 28 is hingedly coupled to the peripheral wall 18 and is selectively positionable in a closed position closing the cavity 20 or in an open position opening the cavity 20. The cavity 20 has a width generally between 6 inches and 7 inches, a height generally between 3 inches and 4 inches, and a depth equal to between 6 inches and 10 inches. In particular, the cavity 20 should have a size adapted for holding at least two conventional soda cans. The cavity 20 may include a refrigeration unit for cooling items contained therein or a microwave unit for heating items contained therein.

An insulating material 30 is positioned on and covers an inner surface of the cavity 20 and the door 28. The insulating material 30 is preferably a plastic insulation material having a rigid construction.

A light socket 32 is attached to the top wall 16 of the housing 12 and an electric power supply 34 is electrically coupled to the light socket 32. A conventional switch may 36 be electrically coupled to the power supply 34 for selectively turning power on or off to the light socket 32.

A drawer 38 is slidably extendable into the peripheral wall 18 of the housing 12. The drawer 38 is positioned between the cavity 20 and the bottom wall 14 of the housing 12. The drawer 38 may include a latch assembly requiring actuator actuation in order to open the drawer.

In use, the light socket 32 and housing 12 are used as a lamp for providing light in a conventional manner. However, the cavity 20 defined a compartment for holding beverage cans or food in a thermally insulated environment so that they remain cold or hot. This allows a person to make fewer trips to a refrigerator as extra beverages or food may be stored adjacent to a chair or sitting area.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lamp assembly including:

a housing having a bottom wall, a top wall and peripheral wall being attached to and extending between said top and bottom walls, said peripheral wall having a cavity extending therein, said cavity being bounded by a lower wall, an upper wall and a perimeter wall extending between said upper and lower walls, a door being hingedly coupled to said peripheral wall and being selectively positionable in a closed position closing said cavity or in an open position opening said cavity;

a thermally insulating material being positioned on and covering an inner surface of said cavity and said door; and a light socket being attached to said top wall of said housing, a power supply being electrically coupled to said light socket.

2. The lamp assembly according to claim 1, wherein said cavity has a width generally between 6 inches and 7 inches, a height generally between 3 inches and 4 inches, and a depth equal to between 6 inches and 10 inches.

3. The lamp assembly according to claim 2, further including a drawer being slidably extendable into said housing, said drawer being positioned between said cavity and said bottom wall of said housing.

4. The lamp assembly according to claim 1, further including a drawer being slidably extendable into said housing, said drawer being positioned between said cavity and said bottom wall of said housing.

5. A lamp assembly including:

a housing having a bottom wall, a top wall and peripheral wall being attached to and extending between said top and bottom walls, said peripheral wall having a cavity extending therein, said cavity being bounded by a lower wall, an upper wall and a perimeter wall extending between said upper and lower walls, a door being hingedly coupled to said peripheral wall and being selectively positionable in a closed position closing said cavity or in an open position opening said cavity, said cavity having a width generally between 6 inches and 7 inches, a height generally between 3 inches and 4 inches, and a depth equal to between 6 inches and 10 inches;

a thermally insulating material being positioned on and covering an inner surface of said cavity and said door;

a light socket being attached to said top wall of said housing, a power supply being electrically coupled to said light socket; and a drawer being slidably extendable into said housing, said drawer being positioned between said cavity and said bottom wall of said housing.

* * * * *